US006817589B2

(12) United States Patent
Schmidgall et al.

(10) Patent No.: US 6,817,589 B2
(45) Date of Patent: Nov. 16, 2004

(54) APPARATUS AND METHOD FOR REMOVING JOINT RINGS FROM CURED CONCRETE PRODUCTS

(75) Inventors: Jon A. Schmidgall, Mediapolis, IA (US); Ronald D. Schmidgall, Mediapolis, IA (US); David Stoller, Burlington, IA (US)

(73) Assignee: Hawkeye Concrete Products Co., Mediapolis, IA (US)

( * ) Notice: Subject to any disclaimer, the term of this patent is extended or adjusted under 35 U.S.C. 154(b) by 336 days.

(21) Appl. No.: 09/683,818

(22) Filed: Feb. 19, 2002

(65) Prior Publication Data

US 2003/0155671 A1 Aug. 21, 2003

(51) Int. Cl.[7] ..... B28B 1/04
(52) U.S. Cl. ..... 249/66.1; 249/100; 425/436 RM
(58) Field of Search ..... 249/99, 100, 66.1; 425/469, 436 R, 436 RM

(56) References Cited

U.S. PATENT DOCUMENTS 804,122 A * 11/1905 Hayes ..... 249/99
822,838 A * 6/1906 Fluke ..... 249/152
1,376,349 A * 4/1921 Moody ..... 249/100
3,945,787 A * 3/1976 Walchek ..... 425/262
5,097,632 A * 3/1992 Yamamori et al. ..... 451/5
5,587,185 A 12/1996 Schmidgall et al.

OTHER PUBLICATIONS

Schlusselbauer Maschinenbau GmbH—"BigExact Masterpieces"—p. 13.

* cited by examiner

*Primary Examiner*—Benjamin L. Utech
*Assistant Examiner*—Emmanuel S. Luk
(74) *Attorney, Agent, or Firm*—James C. Nemmers

(57) ABSTRACT

As a part of the manufacture of concrete products, such as concrete pipe, manholes and the like, the joint rings applied during the casting process much be removed. The invention relates to a joint ring removal system in which a vertically oriented concrete product, containing a joint ring, is gripped to hold the product stationary while a joint ring pulling force is applied. Then, a shocking force is applied laterally to the joint ring to free it from the concrete joint. The amount of pulling force applied to the joint ring is less than that required to separate the joint ring from the concrete while the shocking force is applied in a direction transverse to the pulling force so that no harmful tensile shocking forces are transmitted to the concrete joint. The pulling force on the joint ring is variably applied and timed with the shocking force.

3 Claims, 8 Drawing Sheets

APPARATUS AND METHOD FOR REMOVING JOINT RINGS FROM CURED CONCRETE PRODUCTS

BACKGROUND OF INVENTION

This invention relates to machines and processes for manufacturing concrete products, such as concrete pipe, manholes, catch basins, and the like. During the manufacturing process, a joint-forming ring, of cast iron or steel, is pressed into the top of the concrete pipe or manhole segment. This joint ring remains in place during the curing of the concrete in order to ensure a high quality joint. After the concrete is cured, the joint ring must be removed from the concrete product in such a way that the concrete joint of the product is not damaged.

In some operations, the joint rings are removed manually by hammering on the ring and by the use of heavy hand and power tools which involve repetitive movements by the worker that can lead to work related physical conditions. Therefore, to provide protection against cumulative trauma disorder of workers, systems have been developed to automate the joint ring removal operation. In one system, the cured concrete segment is oriented vertically and one ring at a time is pulled from the end of the pipe. As a part of the automation of the joint ring removal, the rings are gripped by appropriate grippers and a shock force is applied vertically along the axis of the pipe to free the joint ring from the product while an axially pulling force is applied. With the known prior art apparatus of this type, it is not uncommon for the concrete joint to be damaged if the pulling force is not applied uniformly to the joint ring. Even so, it is not uncommon for the shocking force, which is applied axially, to cause breakage of the concrete joint.

In another prior art system disclosed in U.S. Pat. No. 5,587,185, the joint ring removal is accomplished while the concrete pipe is positioned horizontally and the joint rings are removed simultaneously from both ends of the pipe. Although this system is utilized in high production automated systems where multiple pipes are being transported along a horizontal conveyor, there is a need for a joint ring removal apparatus and method in production facilities where the concrete pipes are stored vertically for curing and are individually handled using automated robotics. The method and apparatus of the invention will satisfy this need by providing an apparatus and method for removing a joint ring from a cured finished product in a manner that will greatly minimize, if not eliminate, damage to the concrete joint.

SUMMARY OF INVENTION

The method and apparatus of the invention provides a joint ring removal system in which a vertically oriented concrete product containing a joint ring is gripped to hold the product stationary while the joint ring pulling force is applied, and then a shocking force is applied laterally to the joint ring. The amount of pulling force applied to the joint ring is less than that required to separate the joint ring from the concrete while the shocking force is applied in a direction transverse to the pulling force so that no harmful tensile shocking forces are transmitted to the concrete joint. The pulling force on the joint ring is variably applied and timed with the shocking force. The pulling force is applied at multiple locations to the joint ring, and the force at each location is monitored so that the pulling force is applied equally at all locations.

The advantages and features of the method and apparatus of the invention will become more evident from the detailed description of the preferred embodiment set forth hereinafter.

DETAILED DESCRIPTION

As will be understood by those skilled in the art, concrete pipe, manhole segments, and similar products are produced by well known methods in which concrete is poured into a form created by the use of a core and jacket to form a concrete product of the desired size and configuration. After the form is filled with concrete, a joint forming ring is pressed into the wet concrete at the top of the form, and the joint ring is left in place during the curing of the concrete. An example of concrete pipe making machines are illustrated in Schmidgall U.S. Pat. No. 4,708,621 and Schmidgall U.S. Pat. No. 5,234,331. After the concrete product has cured, the joint ring must be removed. The invention relates specifically to the apparatus described hereinafter for removing the joint forming rings from the cured concrete product. The joint rings must be removed from the concrete products without damaging the concrete joint formed as a part of the product. If the concrete joint is damaged, the damaged product will have to be discarded which is a monetary loss to the manufacturer.

Figure 1:
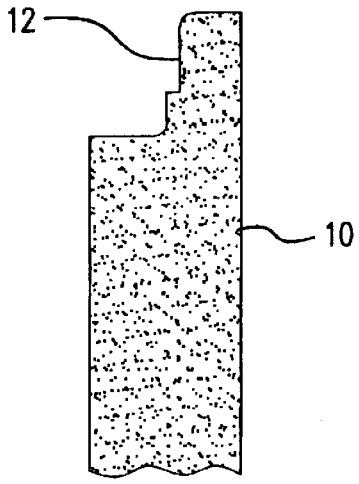
FIG. 1 is a section through the upper portion of a typical concrete product and showing the concrete joint.
Figure 2:
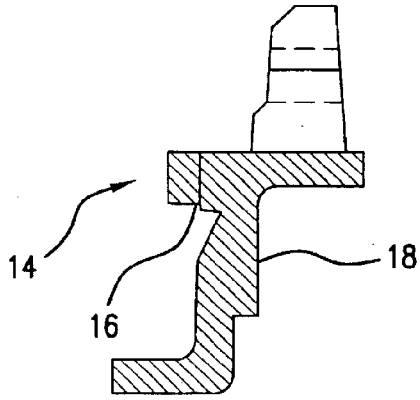
FIG. 2 is a sectional view through a typical joint ring.
Figure 3:
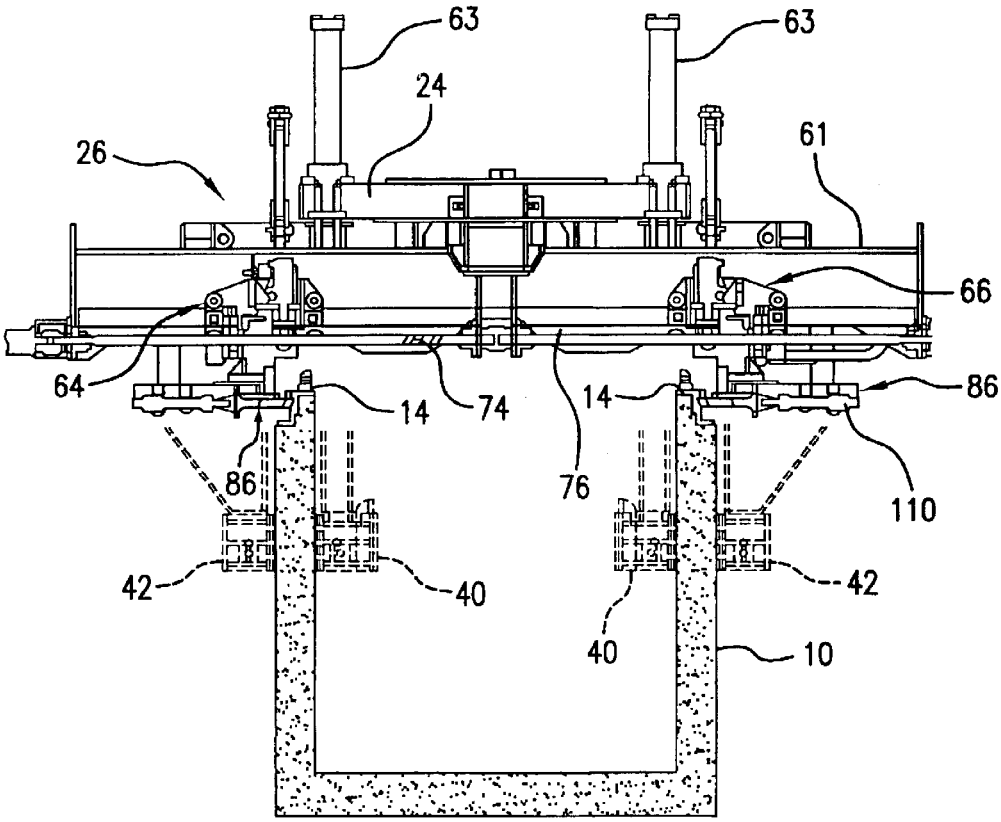
FIG. 3 is a side elevational view of the apparatus of the invention with some components removed and the concrete product and joint ring shown in section.

Referring first to FIGS. 1, 2 and 3, there is illustrated a concrete product such as a concrete segment 10 for a manhole. A section of the upper portion of the segment is shown in FIG. 1. At the top of the segment 10 is formed a joint 12 of a standard configuration. As previously indicated, the joint 12 is formed by placement of a joint ring 14 in the top of the concrete after it is poured into the form to produce the concrete segment, with the joint ring 14 remaining in place until the concrete has cured. FIG. 2 is a sectional view of a typical joint ring 14 which has a groove 16 around its outer surface. The inner surface 18 of the joint ring 14 is shaped to produce the desired shape of the concrete joint 12. FIG. 3 illustrates the joint ring 14 in place at the top of the concrete segment 10.

Figure 4:
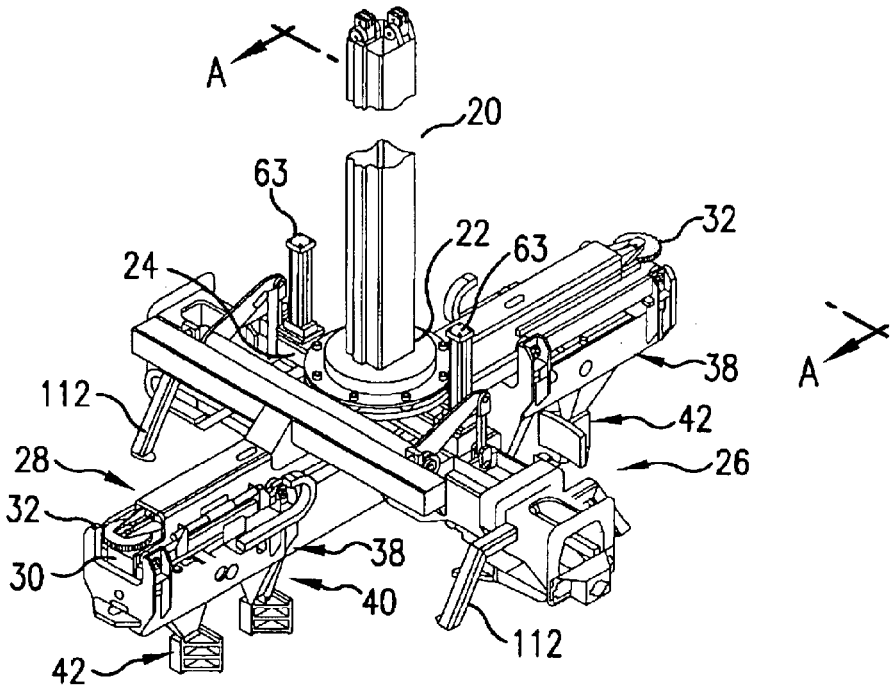
FIG. 4 is a perspective view of the apparatus of the invention.
Figure 5:
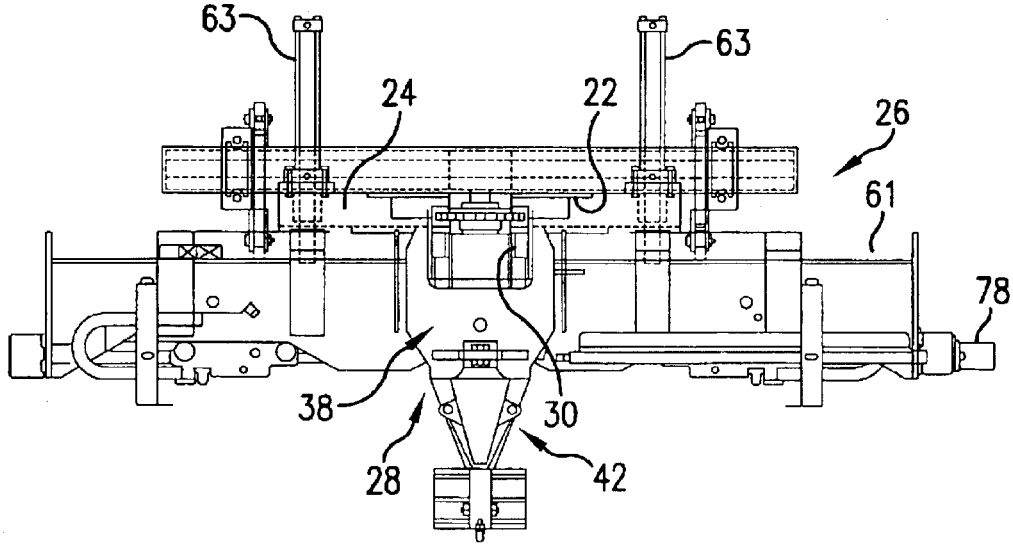
FIG. 5 is an end elevational view viewing the apparatus from the direction indicated by the line A—A of FIG. 4.
Figure 6:
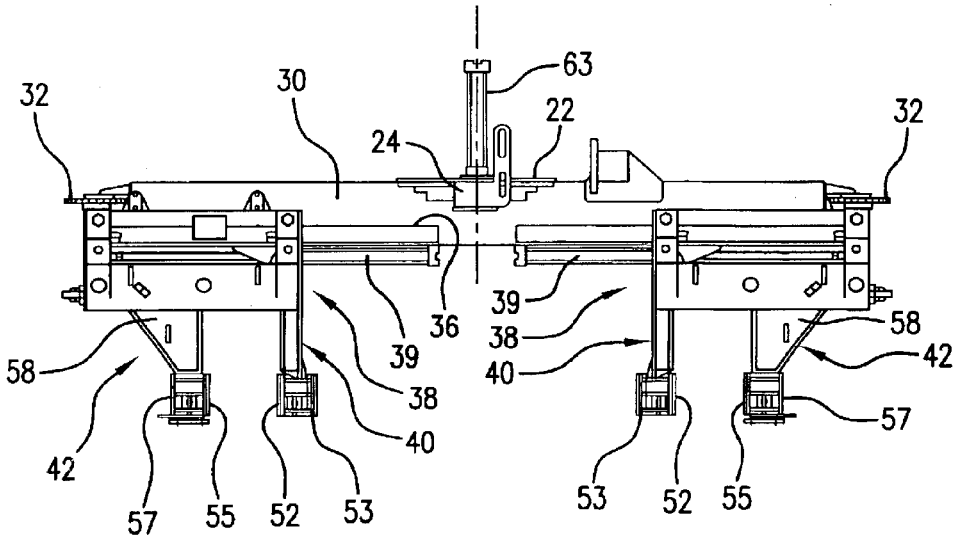
FIG. 6 is a side elevational view of the clamping assembly with some components not shown for purposes of clarity.
Figure 7:
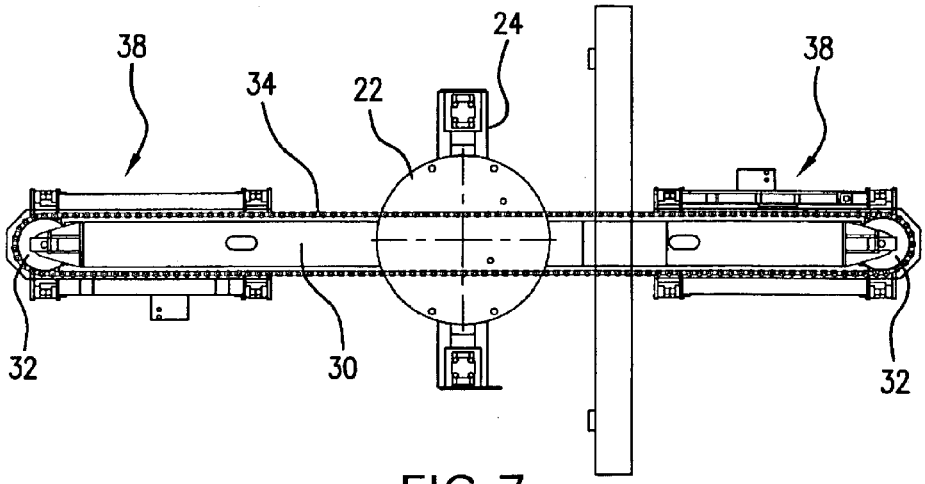
FIG. 7 is a top or plan view of the clamping assembly of FIG. 6.

Referring now to FIGS. 3, 4 and 5, the main components of the apparatus are illustrated. The apparatus includes a vertically extending central beam 20 that provides for connection to suitable handling equipment capable of raising and lowering the joint ring puller apparatus and then moving the joint ring to a desired location for cleaning and storage. Such handling equipment is well known to those skilled in the art and does not form a part of the invention. The central beam 20 may form a part of the handling equipment, but in any event, the beam 20 is suitably connected by plates 22 to the clamping assembly 28 as best seen in FIG. 4.

Figure 8:
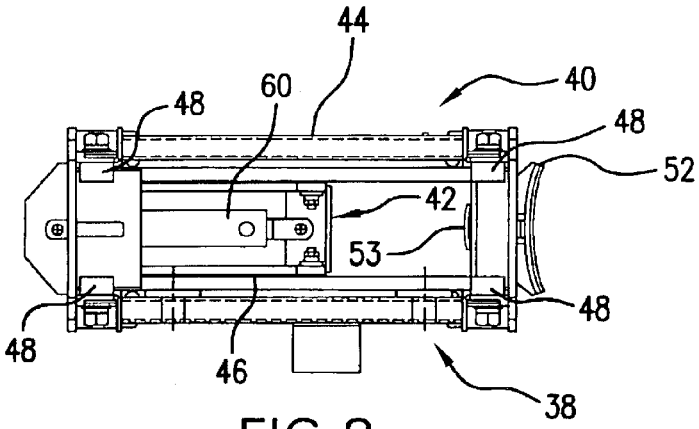
FIG. 8 is a top or plan view of the carriage for the clamping assembly.
Figure 10:
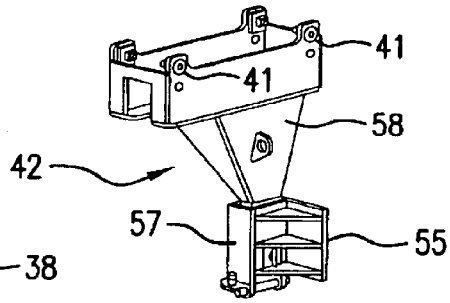
FIG. 10 is a perspective view of the clamp trolley of the carriage of FIGS. 8 and 9.
Figure 9:
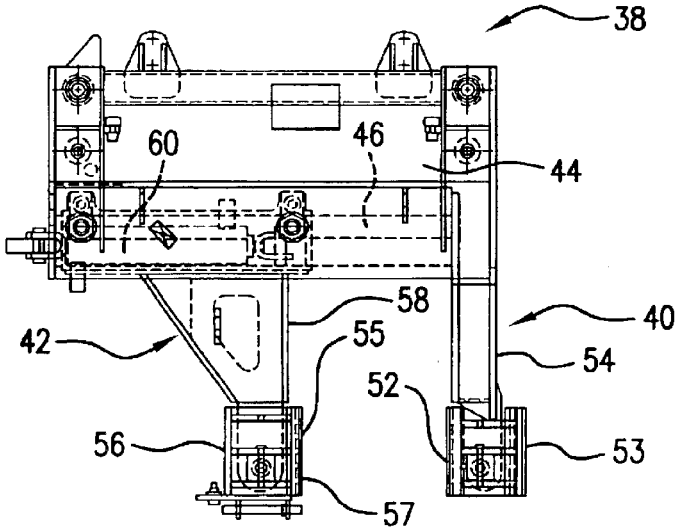
FIG. 9 is a side elevational view of the carriage of FIG. 8.
Figure 11:
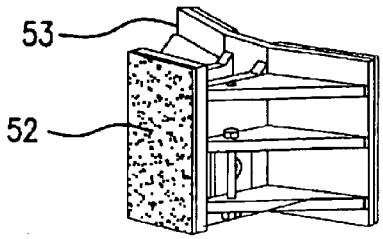
FIG. 11 is a perspective view of an inner clamp pad.

The apparatus of the invention includes two main assemblies, a puller beam assembly 26 and a clamping assembly 28, the latter providing for holding the concrete segment 10 in position and resisting the pulling forces exerted by the puller beam assembly 26 during the joint ring pulling operation. FIGS. 5–11 illustrate the clamping components in which a clamp beam 30 supports at its lower end tracks 36 upon which ride clamp carriages 38. The clamp beam 30 also supports at its lower end cylinders 39 which power the clamp carriages 38. The clamp beam 30 at its lower end also supports tracks 36 upon which ride clamp trolley carriages 38. As best seen in FIGS. 8–10, each clamp carriage 38 is comprised of an inner clamp 40 and a clamp trolley 42. The inner clamp 40 includes an open housing 44 that provides tracks 46 inside of the housing upon which ride the wheels 41 of the clamp trolley 42. The housing 44 also supports wheels 48 which ride on the tracks 36 of the clamp beam 30. The clamp carriages 38 are each mounted at opposite ends of the clamp beam 30 with the wheels 48 engaging the tracks 36. At each end of the clamp beam 30 are secured the sprockets 32 which synchronize and guide the endless chain 34. Each of the clamp trolley carriages 38 is connected to the chain 34, the carriages 38 being connected on opposite sides of the chain 34 so that when one carriage 38 moves outwardly the other carriage 38 will also move outwardly, and similarly, when one of the trolley carriages 38 moves inwardly, the other trolley assembly will also move inwardly. The chain 34 therefore synchronizes the movement of the trolley carriages 38, being powered by cylinders 39.

Each of the inner clamp assemblies 40 has an inner clamp pad 53 with a friction surface 52 affixed to a bracket 54 depending from the inner clamp assembly 40. Each of the inner clamp pads 53 is mounted on the bracket 54 so as to pivot about a horizontal axis. Similarly, an outer clamp pad 57 having a friction surface 55 is mounted about a horizontal pivot on a bracket 58 depending from the clamp trolley 42. As best seen in FIGS. 8 and 9, a hydraulic cylinder 60 has one end secured to the housing 44 of the inner clamp assembly 40 with the other end secured to the clamp trolley assembly 42. The cylinder 60 operates to move the clamp trolley 42 relative to the inner clamp 40. Thus, when the clamp beam 24 is lowered over a manhole or concrete segment 10 for removal of the joint ring 14, the inner clamp assemblies 40, carrying the clamp trolley assemblies 42, will be moved to position the inner clamp pads 53 inside of the concrete segment 10 with the clamp trolley assemblies 42 being positioned by the hydraulic cylinder 60 so that the outer clamp pads 57 are outside of the walls of the concrete segment 10. As illustrated by the dotted lines in FIG. 3, the inner clamp assemblies 40 are moved outwardly until the inner clamp pads 53 engage the interior wall of the concrete segment 10. The hydraulic cylinders 60 will then move the clamp trolley assemblies 42 inwardly until the outer clamp pads 57 engage the outer surfaces of the wall of the concrete segment 10. This will then hold the concrete segment 10 sufficiently firm to resist the forces of the joint pulling assembly which will now be described.

Referring now to FIGS. 3, 4, and 12–17, there are illustrated the basic assemblies and subassemblies for gripping and pulling the joint ring 14. Referring first to FIGS. 3, 12, 13 and 14, there is shown the puller beam assembly 26 with some components removed and not shown for purposes of clarity. The pull bar 24 supports a housing 61 that is movable relative to the pull bar 24 by hydraulic cylinders 63. The housing 61 supports tracks 62 upon which ride pull trolleys, a drive pull trolley 64 and a slave pull trolley 66. The trolleys 64 and 66 are shown in detail in FIGS. 15, 16 and 17, and they are substantially identical in construction, and therefore, only the drive trolley 64 is shown. Each of the trolleys 64 and 66 have wheels 68 that engage the tracks 62, the wheels 68 being mounted on a housing 70 that includes two spaced apart vertical walls 72. The trolleys 64 and 66 are engaged and driven by drive screws 74 and 76 respectively. Drive screw 74 is driven by a hydraulic motor 78 mounted at the outer end of the housing 61, and the drive screw 74 is connected through a drive coupling 80 which in turn causes the drive screw 76 to rotate with the drive screw 74. The drive screw 74 is left-hand threaded while the drive screw 76 is right-hand threaded. This thus allows the drive pull trolley 64 and the slave pull trolley 66 to move in synchronization toward and away from each other under the control of the hydraulic motor 78.

Figure 17:
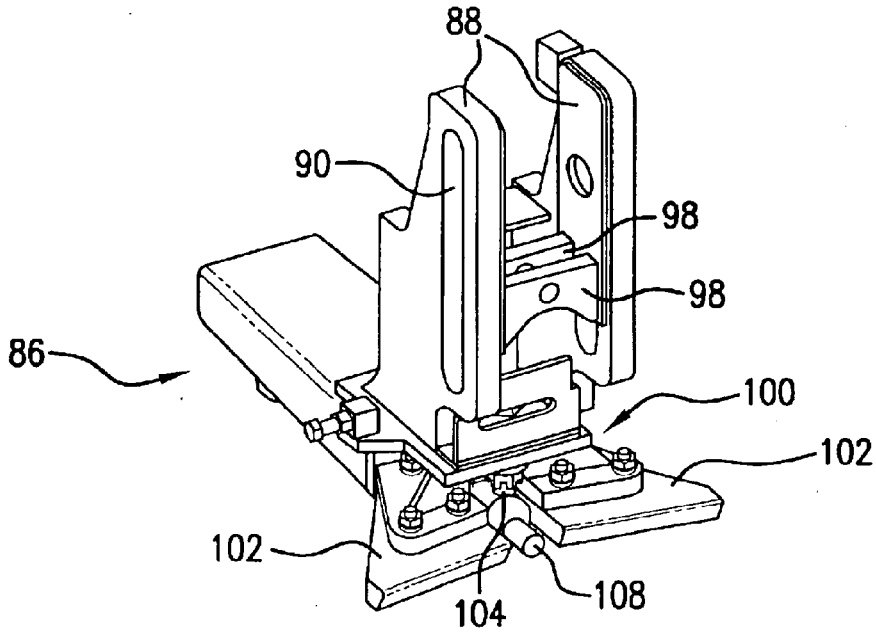
FIG. 17 is a perspective view of a subassembly showing the puller bit.

As previously indicated, the trolleys 64 and 66 include a housing 70 having vertical walls 72 upon which the wheels 68 are mounted. The drive screw 74 extends through a drive nut (not shown) mounted in a bearing 82. Such drives are well known to those skilled in the art. Secured to the lower end of each of the pull trolleys 64 and 66 is a joint ring puller subassembly 86 (FIG. 17). The subassembly 86 includes two spaced apart parallel mounting plates 88 that extend substantially vertically when assembled to the pull trolley 64. As best seen in FIG. 17, the mounting plates 88 have elongated vertically extending grooves 90 so that when the plates 88 are positioned inside of the vertical walls 72 of the pull trolley assembly 64, cam followers (not shown) extending inside of the vertical walls 72 and secured to the walls 72 by fasteners 92 will be engaged in the grooves 90. This allows the joint ring pull assembly 86 to move upwardly and downwardly relative to the pull trolley 64. In order to control and power movement of the puller subassembly 86, a hydraulic cylinder 94 is secured to a mounting plate 96 that forms a part of the housing 70, and the operating rod (not shown) of the hydraulic cylinder will be secured to the cross members 98 (FIG. 17) that are secured to the mounting side plates 88.

The puller subassembly 86 includes a pull bit mounting assembly 100 to which are attached the pull bits 102. The pull bit mounting assembly 100 is mounted for swingable movement about a vertical axis by a pivot pin 104. This permits the pull bits 102 to pivot and securely and properly engage in the groove 16 of the joint ring 14.

As best seen in FIG. 17, the pull bits 102 are spaced apart, and extending between them is a pneumatic hammer 110 that drives a hammer butt 108. The pneumatic hammer 110 drives the hammer butt 108 laterally against the joint ring 14 at the appropriate time as described hereinafter.

Figure 12:
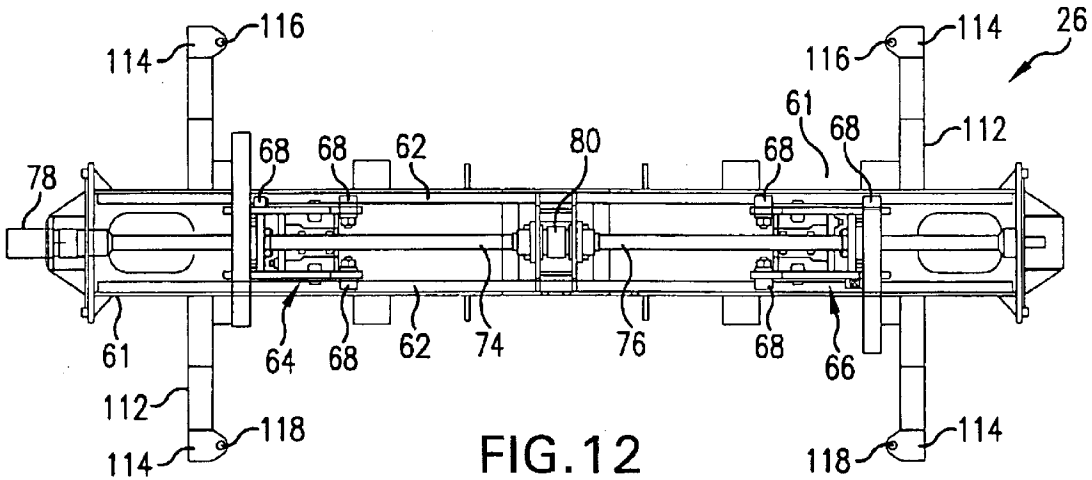
FIG. 12 is a bottom plan view of the pull beam assembly and showing the carriage drive mechanism.
Figure 13:
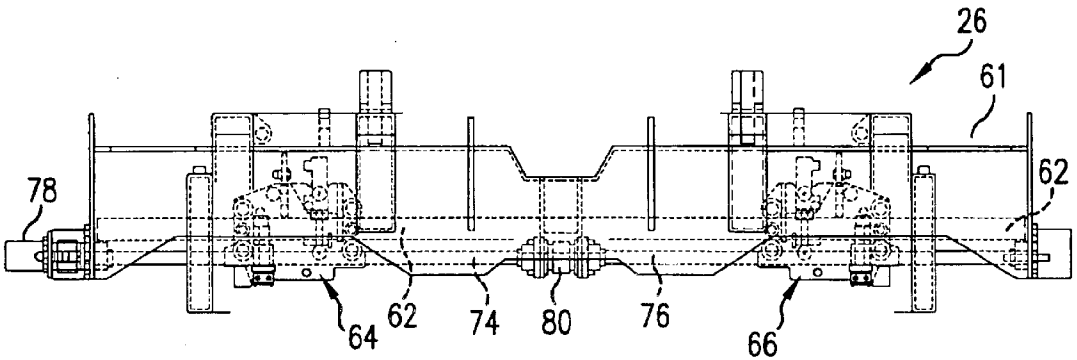
FIG. 13 is a side elevational view of the puller beam assembly of FIG. 12.
Figure 14:
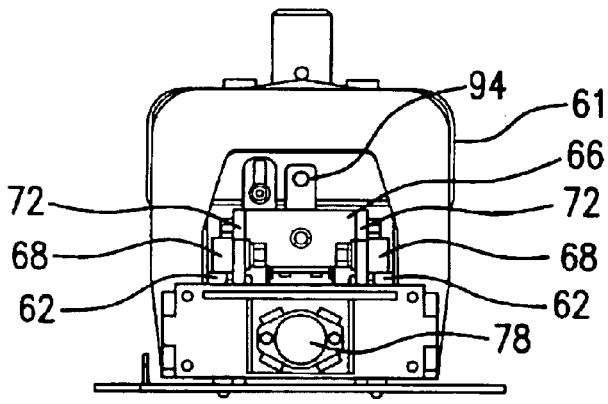
FIG. 14 is an end elevational view of the puller beam assembly.
Figure 15:
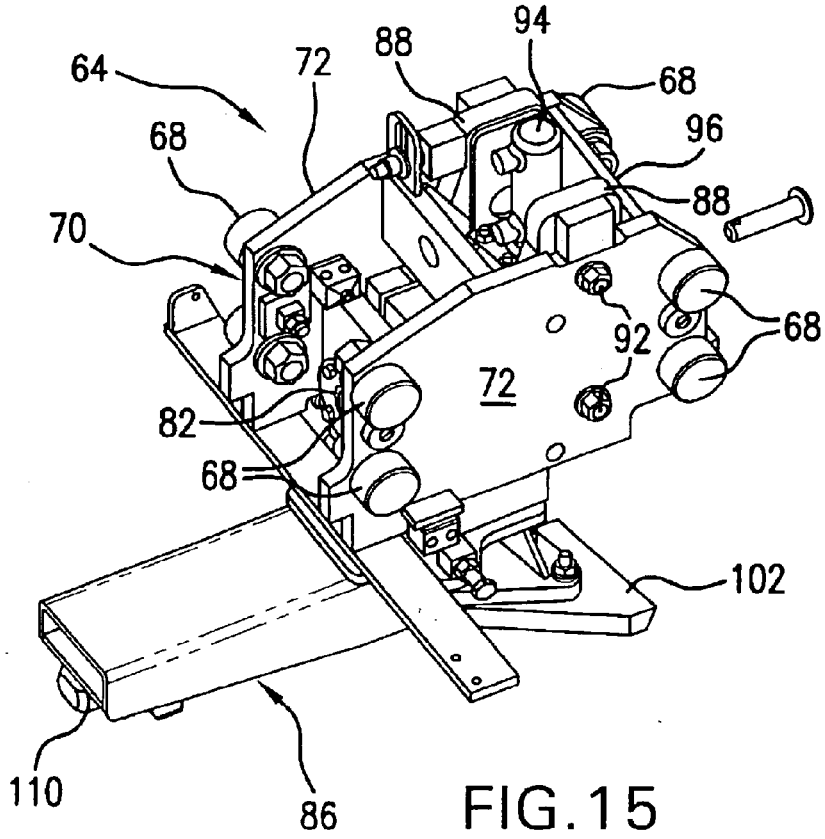
FIG. 15 is a perspective view of a carriage that forms a part of the puller bit assembly.
Figure 16:
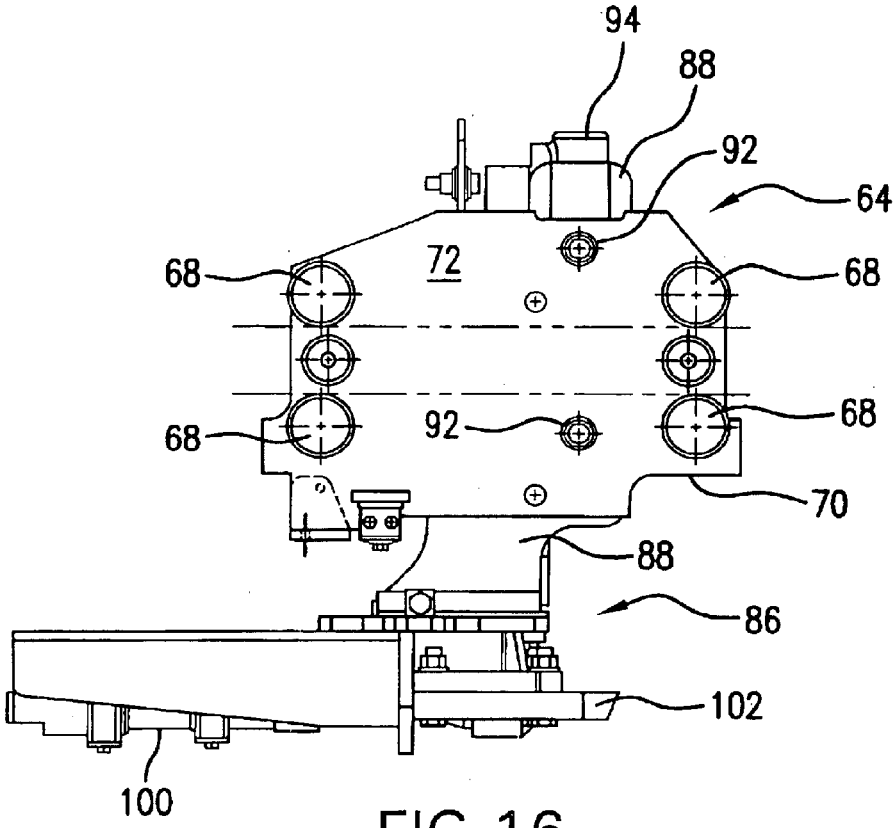
FIG. 16 is a side elevational view of the carriage of FIG. 15.

As illustrated in FIGS. 12 and 13, to assist in proper positioning of the apparatus of the invention relative to a cured concrete segment 10 containing a joint ring 14, there are mounted at opposite ends of the pulling beam assembly 26, transversely extending arms 112 at the outer edges of which are positioned photocells 114. Photocells 114 are installed in pairs on opposite corners so that a transmitter 116 is positioned at the outer end of one arm and a receiver 118 at the other end of the same arm. Thus, both beams emitted from the photocells 114 travel across the center of the pull bar 24. Thus, the beams from the photocells 114 can be used to vertically position the apparatus over the concrete segment 10 the joint ring 14 of which needs to be removed.

Figure 18:
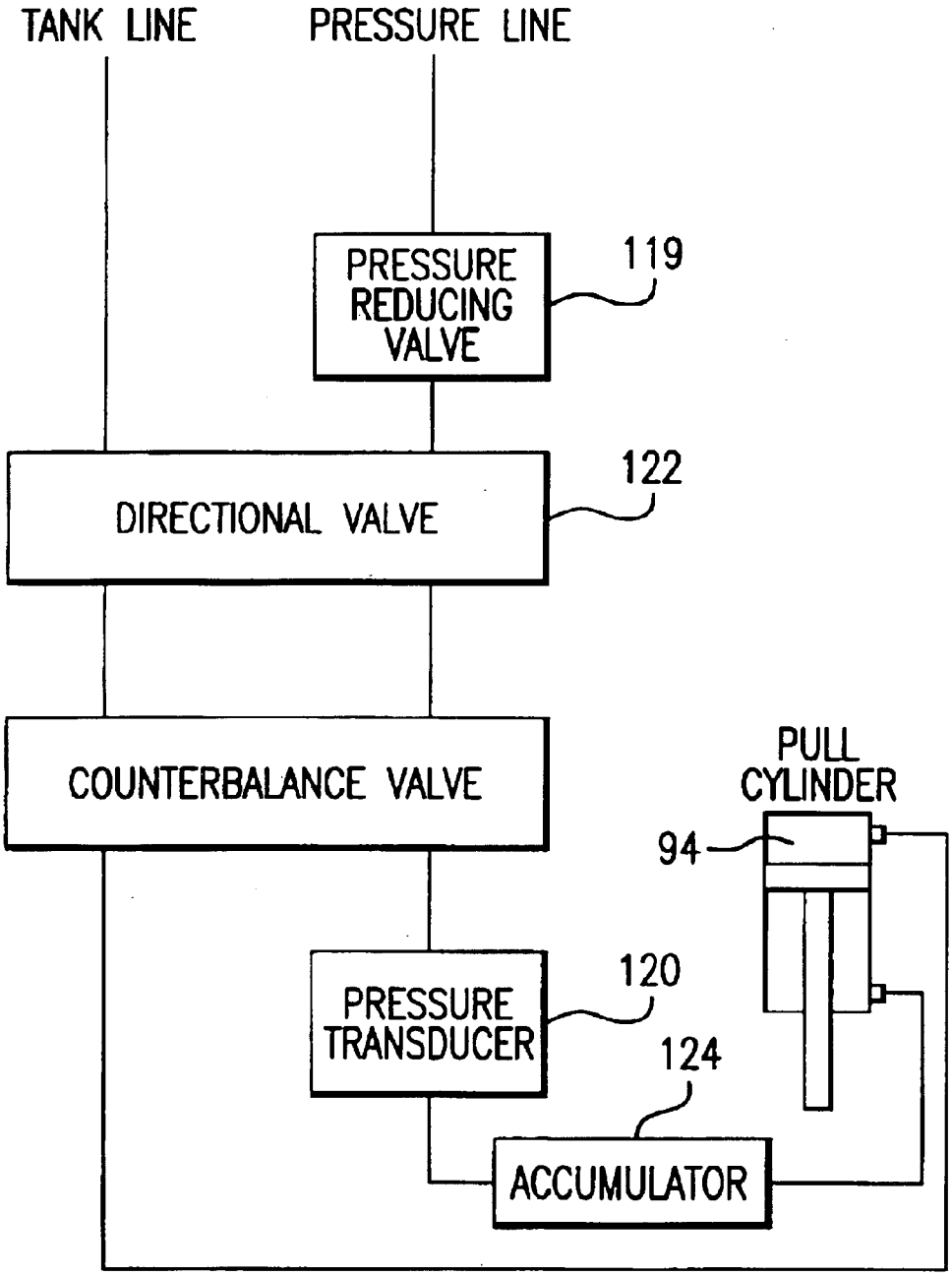
FIG. 18 is a simplified schematic diagram of that portion of the hydraulic system that controls the pull cylinders.

Once the apparatus is properly positioned over a concrete segment 10, and using the hydraulic cylinder 63, the puller beam assembly 26 is lowered to the correct elevation with the pull bits 102 opposite the groove 16 in the joint ring 14. The hydraulic motor 78 is then actuated to drive the drive screws 74 and 76 and thereby move the drive pull trolley 64 and slave pull trolley 66 inwardly until the pull bits 102 are engaged in the groove 16 of the joint ring 14. The clamping assembly 28 is then utilized to position the inner clamp pads 53 inside of the concrete segment 10 and the outer clamp pads 57 positioned outside the concrete segment 10. The hydraulic cylinders 39 are then actuated to move the inner clamps 40 outwardly until the inner clamp pads 53 are engaged with the inside surface of the concrete segment 10. Subsequently, the hydraulic cylinder 60 inside of the drive trolley 42 is actuated to move the drive trolleys 42 inwardly until they engage the outer surface of the concrete segment 10. The inner clamp pads 53 and outer clamp pads 57 will then apply a clamping force to the concrete segment 10 sufficient to hold the segment 10 stationary during the joint ring pulling process. The hydraulic cylinders 94 are then actuated to apply an initial tensile force to the joint ring 14. This initial tensile force is less than that required to separate the joint ring 14 from the concrete joint 12. Each pull bit cylinder 94 is supplied with a predetermined pressure by pressure relief valve 119 for the particular concrete segment 10 being processed, and the pull bits 102 are moved upwardly and independently until the bits of each of the puller assemblies 86 firmly engage the joint ring groove 16. As the pull bits 102 in each of the puller assemblies 86 are so engaged, the pressure in each cylinder 94 increases to a predetermined pulling pressure as monitored by means of a pressure transducer 120 (FIG. 18), after which a directional control valve 122 supplying the hydraulic fluid to each cylinder 94 is closed. When the valve 122 for each pull cylinder 94 is closed, pressure is trapped in the cylinder 94. The hydraulic circuit is equipped with an accumulator 124 that will maintain the pressure in the pull cylinders 94 while limiting the distance that each pull cylinder 94 can travel. By thus limiting the travel of the pull cylinders 94, the joint ring 14 can be slightly separated from the concrete joint 12 without traveling far enough to possibly bind the joint ring 14 on the concrete joint 12, which binding is a major cause of breakage of the joint 12. Thus, the independent control of each pull bit cylinder 94 ensures that the joint ring 14 is pulled evenly, and any misalignment between the two joint puller assemblies 86 and the joint ring 14 is compensated for in this manner. Without independent control of each of the pull cylinders 94, there is a greater risk of the joint ring 14 binding and damaging the concrete joint 12.

After the pull bit control valve for each cylinder 94 closes and the tensile force is thus maintained on the joint ring 14 by the pull bits 102, the pneumatic hammers 110 are actuated to apply a lateral force through the hammer butts 108 against the joint ring 14 in order to break the bond between the joint ring 14 and the concrete joint 12. By applying the shock force laterally, the concrete joint 14 is protected from breakage. The pressure transducers 120 are monitored for a pressure decrease which will indicate that the joint ring 14 has broken free from the concrete joint 12. The volume of oil in the accumulator 124 of the hydraulic circuit thus allows only a small vertical separation of the joint ring 14 from the concrete joint 12. When the drop in pressure is thus sensed by transducer 120, the puller beam assembly 26 is then lifted vertically by cylinders 63 to completely separate the joint ring 14 from the concrete joint 12 thus completely the pulling process. When the pulling process is complete, the pressure on the hydraulic cylinders 60 holding the inner clamp pads 53 and outer clamp pads 57 is released, and the hydraulic cylinders 39 are actuated to withdraw the clamp carriages 38 and 40. The entire apparatus is then lifted from the concrete segment 10, carrying with it the joint ring 14 for movement to a cleaning and storage area.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. An apparatus for removing a joint ring from a concrete product such as a concrete pipe or manhole segment, which joint ring was placed during the manufacture of the concrete product to form a joint in the final product, said apparatus comprising: a puller beam assembly moveable toward and away from a concrete product positioned for joint ring removal and having pull bits independently moveable inwardly and outwardly toward and away from the joint ring to be removed as to engage the joint ring on opposite sides; first power units for moving the pull bits inwardly and outwardly; a clamping assembly have inner and outer clamps adapted to engage the concrete product and restrain the concrete product from movement during the removal of the joint ring; second power units for applying an independent tensile force to the pull bits to pull the joint ring from the concrete product; a pressure transducer for monitoring the tensile force applied to the joint ring by each pull bit; a first control responsive to the pressure transducers to maintain a predetermined initial tensile force on each pull bit; a pneumatic hammer combined with each pull bit to apply a shock force laterally to the joint ring through the pull bit; the pressure transducers being adapted to sense a drop in the tensile forces which drop indicates the joint ring is freed from the concrete product; and a second control responsive to the pressure transducers to signal the puller assembly to move away from the concrete product thereby carrying with the assembly the joint ring.

2. The apparatus of claim 1 in which the first and second power units are hydraulic cylinders, and the pressure transducers sense the pressure in the cylinders, and an accumulator is provided to maintain the initial tensile force on each pull bit by the cylinders, thus limiting the travel of the pull bits to avoid binding of the joint ring until the joint ring is freed from the concrete product by action of the shock forces.

3. The apparatus of claim 2 in which the pressure transducers sense a pressure drop in the hydraulic cylinders, the accumulator providing for only a small amount of separation of the joint ring from the concrete product until the joint ring is moved away from the concrete product by the puller assembly.

* * * * *